US005709395A

United States Patent [19]

Lee

[11] Patent Number: 5,709,395

[45] Date of Patent: Jan. 20, 1998

[54] THREE WHEEL ROLLER SKATE

[76] Inventor: Charles Lee, P.O. Box 22887, GMF, Barrigada, Guam, 96921

[21] Appl. No.: 586,367

[22] Filed: Jan. 16, 1996

[51] Int. Cl.[6] ..... A63C 17/04; A63C 17/14; A63C 17/20

[52] U.S. Cl. ..... 280/11.2; 280/11.19; 280/11.21; 188/69

[58] Field of Search ..... 280/11.19, 11.2, 280/11.21, 7.1, 7.17, 825, 841; 188/31, 69, 74, 265

[56] References Cited

U.S. PATENT DOCUMENTS

| | | | |
|---|---|---|---|
| 1,016,447 | 2/1912 | Sheahan | 280/11.2 |
| 1,230,491 | 6/1917 | Konietzky | 280/11.2 |
| 1,276,212 | 8/1918 | Hardy | 280/11.19 |
| 1,517,352 | 12/1924 | Foote | 280/11.2 |
| 3,086,787 | 4/1963 | Wyche | 280/11.29 |
| 4,817,974 | 4/1989 | Bergeron | 280/11.19 |
| 4,966,377 | 10/1990 | Yu | 280/11.2 |
| 5,232,231 | 8/1993 | Carlsmith | 280/11.2 |
| 5,340,131 | 8/1994 | Smathers et al. | 280/11.2 |

*Primary Examiner*—Anne Marie Boehler
*Attorney, Agent, or Firm*—Michael I. Kroll

[57] ABSTRACT

A three wheel roller skate (10) that can be better maneuvered than a four wheel roller skate, yet allowing an inexperienced or beginner roller skater (16) to enjoy roller skating. A built-in mechanism has three functions, which are: function 1, to lock all wheels (20), (22) in a stop position; function 2, to unlock all wheels (20), (22) in a free rotation position; and function 3, to prevent the front wheels (22) from rotating backwards in an anti-reverse position.

12 Claims, 3 Drawing Sheets

Fig-1
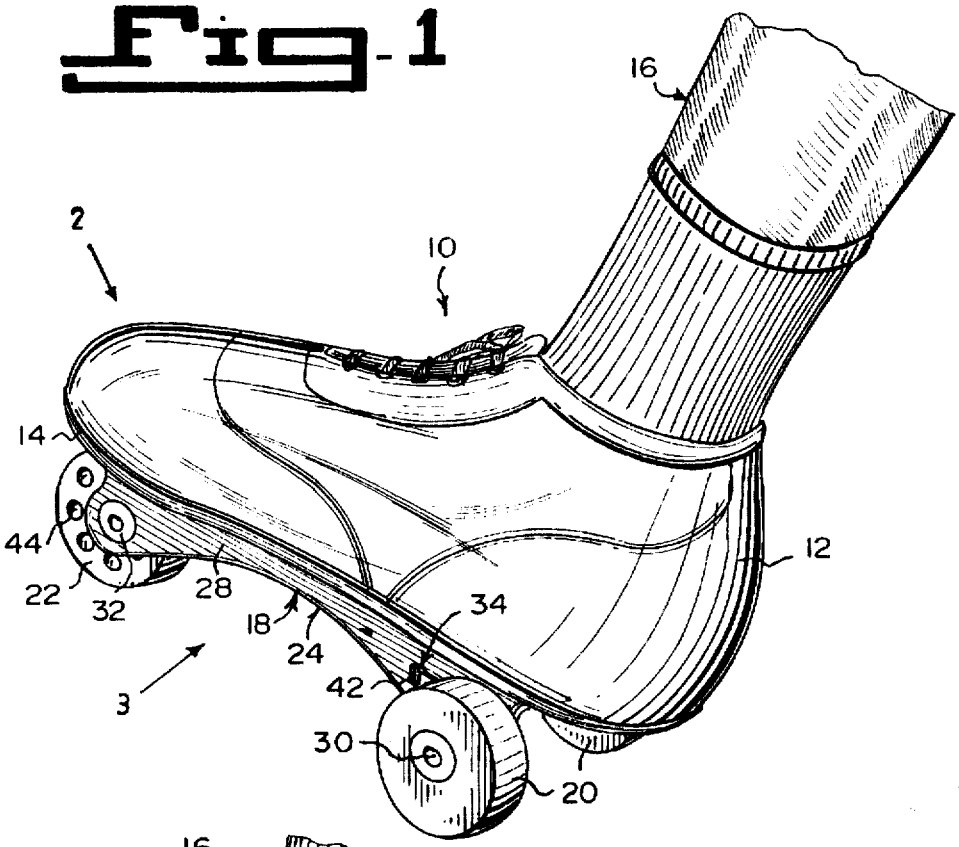
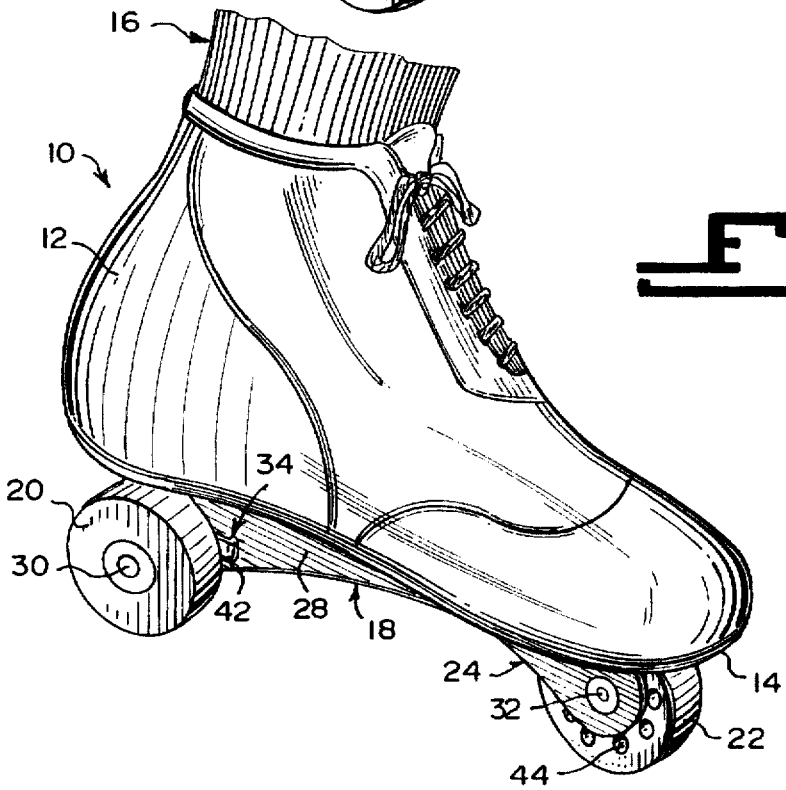
Fig-2

THREE WHEEL ROLLER SKATE

BACKGROUND OF THE INVENTION

FIELD OF THE INVENTION

The instant invention relates generally to roller skates and more specifically it relates to a three wheel roller skate.

The Dutch word schaats means stilt, as well as skate, and people who wear skates are lifted above the ground just enough to roll down the sidewalk in warm weather. Indoor rinks make it possible for them to roller-skate year-round.

Most boys and girls learn how to skate on driveways, sidewalks, or playgrounds. Beginning skaters usually wear adjustable clamp skates, which fasten to the soles of their regular shoes or boots. The molded toe clamps are tightened with a skate key, and leather straps bind the skates to the ankle. Strap-on skates have flexible Velcro fastenings.

Skates first rolled on wooden wheels, then wheels of steel. Rubber-wheeled skates were introduced by the 1920's, but kids generally continued to wear the noisy metal models. Roller skating boomed as a pastime in the late 1970's after skates were equipped with the quiet and smooth-roller polyurethane wheels that had been developed for skate-boards. Sealed ball bearings and toe stops of plastic or rubber also improved maneuverabiity and added to their versatility.

Shoe skates often resemble running shoes mounted on wheels. Although ankle support is not essential for roller skating, mid-high and high-top models are available-traditionally in black for men and white for women. Arm and knee pads are optional.

In-line skates, the fad of the 1980's have polyurethane roller wheels aligned in a strip, like an ice-skating blade. Originally a heavy metal truck across the bottom held the wheels in place, but faster models use plastic or light aluminum trucks and can travel at about twice the speed of traditional roller skates. For braking, the molded ski-type boots have one rubber backstop, rather than double toe stops. To complete the glitzy image of in-liners' neon colors, including glow-in-the-dark wheels, there are coordinated shoelaces, headgear, fingerless gloves, boot bags, and fanny packs. Headphones and watches with an in-line designer logo complete the high-tech look.

Because of the market dominance of the company that introduced in-line skates in 1980, the sport is often called Roller blading, or blading. In-liners were designed by the Olson brothers of Minneapolis—Scott, a young hockey player, and Brennan—for off-season training for skiers as well as ice hockey skaters. Another brand, called Switchit, can accommodate both wheels and ice-skating blades. For aerobic conditioning, blading often replaces jogging and workouts.

Roller hockey is usually played outdoors. Indoor skaters enjoy roller dancing to music, figure skating, and speed skating on hardwood, plastic-coated tracks. Professional speed skaters may compete on Roller Derby teams, racing one another on a banked track.

DESCRIPTION OF THE PRIOR ART

Numerous roller skates have been provided in prior art. For example, U.S. Pat. No. 2,166,767 to Petermann; U.S. Pat. No. 5,069,462 to Murga; U.S. Pat. No. 5,192,088 to Yu and U.S. Pat. No. 5,251,920 to McHale all are illustrative of such prior art. While these units may be suitable for the particular purpose to which they address, they would not be as suitable for the purposes of the present invention as heretofore described.

PETERMANN, HENRI

ROLLER SKATE

U.S. Pat. No. 2,166,767

A roller skate comprising an elongated support. a plurality of axles are carried by the support. a pair of separate rollers are carried by each axle. Each roller comprises an outer rim member having a spherical bearing surface constituting a continuation of the spherical bearing surface of the other roller carried by the same axle. A ball bearing is interposed between the rim member and the axle and comprises an inner ring fitting within the rim member and is rotatable therewith. A sleeve is mounted upon the axle. A row of balls are situated between the inner ring and the sleeve. The axle has a threaded portion. A nut is screwed upon the threaded portion and engages the sleeve.

MURGA, JOSE

ROLLER SKATE INCLUDING AT LEAST TWO ROLLERS ALIGNED ALONG A MEDIAN PLANE

U.S. Pat. No. 5,069,462

The skate includes an under-frame equipped with two or several rollers aligned one behind the other in a common median plane. Each roller has a shape of a narrow-bobbin, with two circular flanges provided with bands and a central hollowed hub fixed inside a ball-bearing. This bearing is put in an orifice of a central plate of the under-frame. This plate holds also a front buffer-stop and a back buffer-stop. An instrument absorbing the shocks in the radial direction if intercalated between the bearing and the plate. Preferably, the under-frame of the skate is equipped with a support for a leg, which is articulated in relation to a transverse axis at the level of the ankle. A braking mechanism of the rollers can be fixed on the central plate of the under-frame. Thanks to the special shape of the rollers, bearings and the under-free are lightened.

YU, CHUNG-HSIUNG

ROLLER SKATE WITH DEVICE FOR ASSISTING THE TURNING AND BRAKING ACTION THEREOF

U.S. Pat. No. 5,192,088

A roller skate having rollers aligned along a longitudinal axis thereof is equipped with a device which includes a mounting seat attached to the skate body adjacent to the front or rear end thereof. A pair of mounting shafts are mounted on the mounting seat and extend in such a manner that they form an angle therebetween and that they are symmetric with respect to the longitudinal axis. A pair of auxiliary rollers are mounted respectively to the mounting shafts, so that they lie in two imaginary planes which are perpendicular to the mounting shafts, respectively, and which form a V-shape symmetric with respect to the longitudinal axis. The device assists the turning and braking action of the roller skate.

McHALE, PATRICK

BEAM OFF-SET ROLLER SKATE

U.S. Pat. No. 5,251,920

Roller skates having a shoe or boot supported by a central support beam. The boot has an inside and outside corresponding to the inside and the outside of a user's foot to which it is designed to be removably attached. Each skate also has a first and second group of wheels in longitudinal alignment with the roller skate and in rotatable alignment with each other. The boot and groups of wheels are connected to a support structure. The first group of wheels is rotatably attached to the support structure and disposed to the outside thereof. The second group of wheels is rotatably attached to the support structure and disposed to the inside thereof. A first span between the most distant of the wheels of the first group of wheels is less than a second span between the most distant of the wheels of the second group of wheels. There are also brake means for slowing and stopping the roller skate when a user desires.

SUMMARY OF THE INVENTION

A primary object of the present invention is to provide a three wheel roller skate that will overcome the shortcomings of the prior art devices.

Another object is to provide a three wheel roller skate that can be better maneuvered than a four wheel roller skate, yet allowing an inexperienced or beginner roller skater to enjoy roller skating.

An additional object is to provide a three wheel roller skate that includes a built-in mechanism having three functions, which are function 1, to lock all wheels, a stop position function 2, to unlock all wheels in a free rotation position, and function 3, to prevent the front wheel from rotating backwards in an anti-reverse position.

A further object is to provide a three wheel roller skate that is simple and easy to use.

A still further object is to provide a three wheel roller skate that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a rear perspective view of the instant invention worn on a foot of a roller skater.

FIG. 2 is a front perspective view taken in the direction of arrow 2 in FIG. 1.

Figures 3, 3A, 3B, 3C:
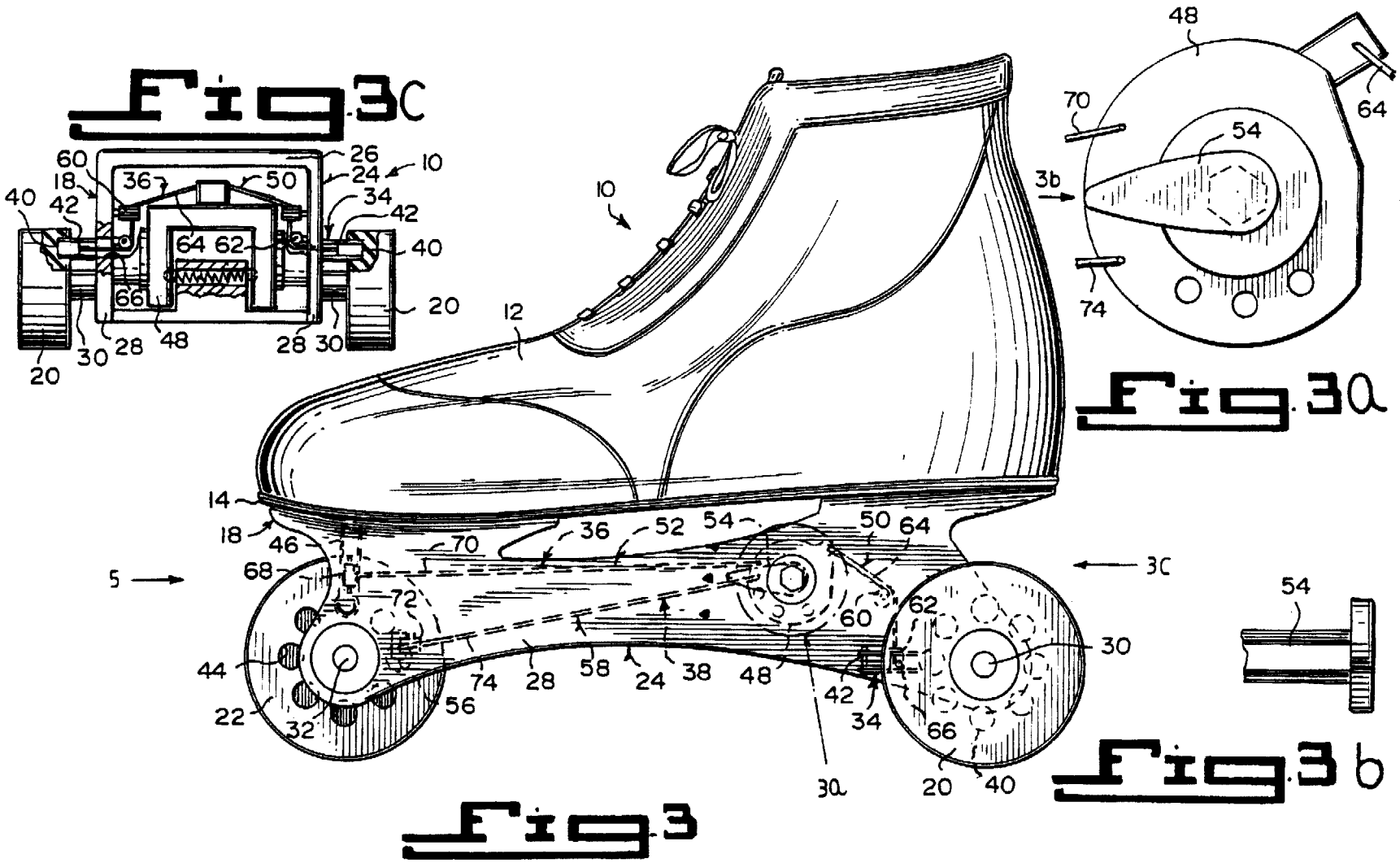
FIG. 3 is a side view of the instant invention per se taken in the direction of arrow 3 in FIG. 1.

FIG. 3*a* is an enlarged side view of the control cam as indicated by arrow 3*a* in FIG. 3, with the function change key in place.

FIG. 3*b* is an end view of the function change key with parts broken away taken in the direction of arrow 3*b* in FIG. 3*a*.

FIG. 3*c* is a rear view taken in the direction of arrow 3*c* in FIG. 3, with parts broken away and in section.

Figure 4:
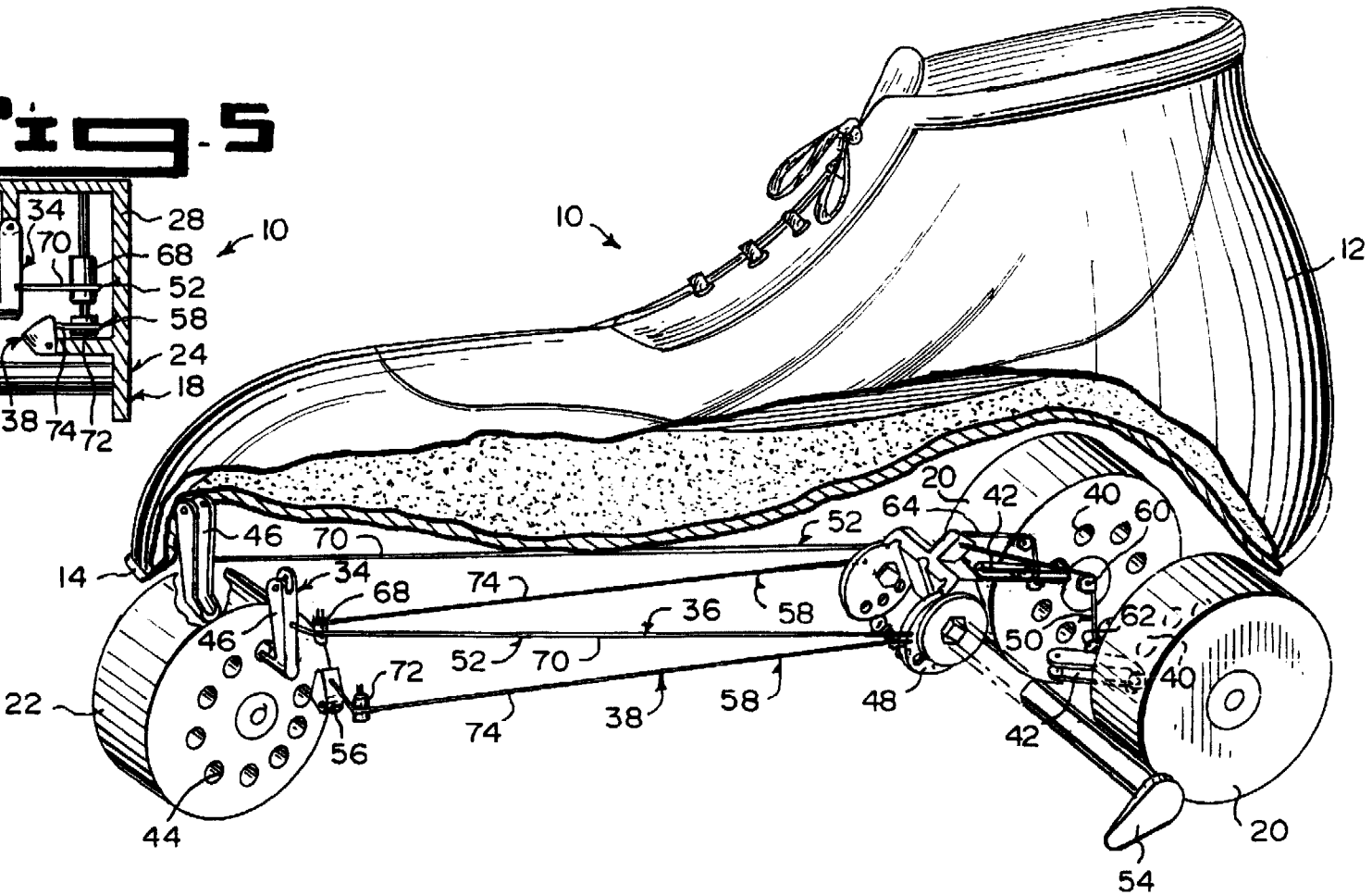

FIG. 4 is a front perspective view of the instant invention per se with parts broken away and in section.

Figure 5:
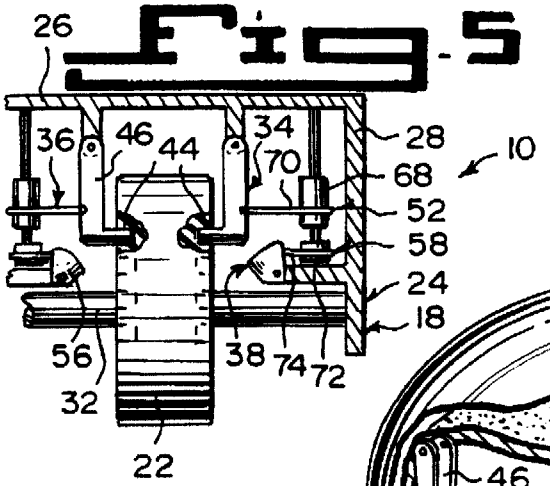

FIG. 5 is a front view taken in the direction of arrow 5 in FIG. 3, with parts broken away and in section.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 through 5 illustrate a three wheel roller skate 10 which comprises a boot 12 having a sole 14, wherein the boot 12 is worn on a foot of a roller skater 16. A support frame 18 is attached to the sole 14 of the boot 12. A pair of rear wheels 20 are mounted in a rotatable manner to a rear end of the support frame 18. A front wheel 22 is mounted in a rotatable manner to a front end of the support frame 18, so that the roller skate 10 can be better maneuvered by the roller skater 16.

The support frame 18 is a generally U-shaped bracket 24 attached to the sole 14 of the boot 12 in an inverted manner. The U-shaped bracket 24 includes a base 26 attached to the sole 14 of the boot 12. A pair of arms 28 extend downwardly from the base 26. Each axle 30 of the rear wheels 20 is mounted to an exterior surface of one arm 28. An axle 32 of the front wheel 22 is mounted between interior surfaces of the arms 28.

The components 34 are for locking the rear wheels 20 and the front wheel 22, so as to prevent the rear wheels 20 and the front wheel 22 from rotating. A mechanism 36 is for unlocking the rear wheels 20 and the front wheel 22, so as to allow the rear wheels 20 and the front wheel 22 to rotate. A facility 38 is for preventing the front wheel 22 from rotating backwards, so as to allow the front wheel 22 to only rotate forwards.

The locking components 34 consist of each rear wheel 20 having a plurality of apertures 40 radially positioned on an inner surface about the axle 30 and faces the exterior surface of one arm 28. A pair of rear wheel stop levers 42 are provided. Each rear wheel stop lever 42 is spring biased hinged to the exterior surface of one arm 28. Each rear wheel stop lever 42 will normally engage with one aperture 40 in one rear wheel 20. The front wheel 22 has a plurality of bores 44 radially positioned on opposite surfaces about the axle 32 and faces the interior surfaces of the arms 28. A pair of front wheel stop levers 46 are also provided. Each front wheel stop lever 46 is spring biased hinged to the interior surface of one arm 28. Each front wheel stop lever 46 will normally engage with one bore 44 in the front wheel 22.

The unlocking mechanism 36 comprises a control cam 48 mounted in a rotatable manner between the arms 28. A pair of rear connector assemblies 50 extend between the control cam 48 and the rear wheel stop levers 42. A pair of front connector assemblies 52 extend between the control cam 48 and the front wheel stop levers 46. A control change key 54 is insertable into the control cam 48, so as to rotate the control cam 48 in a first direction to release the rear wheel stop levers 42 from the apertures 40 in the rear wheels 20 and the front wheel stop levers 46 from the bores 44 in the front wheel 22.

The preventing facility 38 includes a pair of front wheel anti-reverse levers 56. Each front wheel anti-reverse lever 56 is spring biased hinged to the interior surface of one arm 28. Each front wheel anti-reverse lever 56 will normally be disengaged from the bores 44 in the front wheel 22. A pair of auxiliary front connector assemblies 58 extend between the control cam 48 and the front wheel anti-reverse levers 56. When the control change key 54 in the control cam 58 rotates the control cam 58 in an opposite direction, the anti-reverse levers 56 will now engage with the bores 44 in the front wheel 22, to allow the front wheel 22 to rotate forwards but not backwards.

Each rear connector assembly 50 contains a first pulley 60 carried in a rotatable manner on the inner surface of one arm 28, spaced behind the control cam 48. A second pulley 62 is carried in a rotatable manner on the inner surface of the arm 28 spaced below at a right angle to the first pulley 60 adjacent one rear wheel stop lever 42 in front of the arm 28. A cable 64 extends from the back of the control cam 46 about the first pulley 60, the second pulley 62 and through an aperture 66 in the arm 28 to the rear wheel stop lever 42.

Each front connector assembly 52 includes a pulley 68 carried in a rotatable manner from the inner surface of the base 26 adjacent the front wheel stop lever 46. A cable 70 extends from the front of the control cam 48 about the pulley 68 to the front wheel stop lever 46.

Each auxiliary front connector assembly 58 consists of a pulley 72 carried in a rotatable manner from an inner surface of one arm 28 adjacent the front wheel anti-reverse lever 56. a cable 74 extends from the front of the control cam 48 about the pulley 72 to the front wheel anti-reverse lever 56.

LIST OF REFERENCE NUMBERS

10 three wheel roller skate
12 boot of 10
14 sole on 12
16 roller skater
18 support frame of 10
20 rear wheel of 10
22 front wheel of 10
24 U-shaped bracket for 18
26 base of 24
28 arm of 24
30 axle of 20
32 axle of 22
34 locking component of 10
36 unlocking mechanism of 10
38 preventing facility of 10
40 aperture in 20
42 rear wheel stop lever of 34
44 bore in 22
46 front wheel stop lever of 34
48 control cam of 36
50 rear connector assembly of 36
52 front connector assembly of 36
54 control change key of 36
56 front wheel anti-reverse lever of 38
58 auxiliary front connector assembly of 38
60 first pulley of 50
62 second pulley of 50
64 cable of 50
66 aperture in 28
68 pulley of 52
70 cable of 52
72 pulley of 58
74 cable of 58

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A three wheel roller skate which comprises:

a) a boot having a sole, wherein said boot is worn on a foot of a roller skater;

b) a support frame which is a generally U-shaped bracket attached to said sole of said boot in an inverted manner, said U-shaped bracket including:

i) a base attached to said sole of said boot;

ii) a pair of rear wheels mounted in a rotatable manner to a rear end of said support frame; and iii) a front wheel mounted in a rotatable manner to a front end of said support frame, so that said roller skate can be better maneuvered by the roller skater; and iv) a pair of arms extending downwardly from said base, wherein each axle of said rear wheels is mounted to an exterior surface of one said arm, while an axle of said front wheel is mounted between interior surfaces of said arms;

c) means for locking said rear wheels and said front wheel, so as to prevent said rear wheels and said front wheel from rotating, said locking means including:

i) each said rear wheel having a plurality of apertures radially positioned on an inner surface about the axle and facing the exterior surface of one said arm;

ii) a pair of rear wheel stop levers, in which each said rear wheel stop lever is spring biased hinged to the exterior surface of one said arm, so that each said rear wheel stop lever will normally engage with one said aperture in one said rear wheel;

iii) said front wheel having a plurality of bores radially positioned on opposite surfaces about the axle and facing the interior surfaces of said arms; and iv) a pair of front wheel stop levers, in which each said front wheel stop lever is spring biased hinged to the interior surface of one said arm, so that each said front wheel stop lever will normally engage with one said bore in said front wheel.

2. A three wheel roller skate as recited in claim 1, further comprising an unlocking means for the front and rear wheels so as to allow the front and rear wheels to rotate, said unlocking means comprising:

a) a control cam mounted in a rotatable manner between said arms;

b) a pair of rear connector assemblies extending between said control cam and said rear wheel stop levers;

c) a pair of front connector assemblies extending between said control cam and said front wheel stop levers; and d) a control change key insertable into said control cam, so as to rotate said control cam in a first direction to release said rear wheel stop levers from said apertures in said rear wheels and said front wheel stop levers from said bores in said front wheel.

3. A three wheel roller skate as recited in claim 2, wherein each rear connector assembly includes:

a) a first pulley carried in a rotatable manner on the inner surface of one said arm, spaced behind said control cam;

b) a second pulley carried in a rotatable manner on the inner surface of said arm spaced below at a right angle to said first pulley adjacent one said rear wheel stop lever in front of said arm; and c) a cable extending from the back of said control cam about said first pulley, said second pulley and through an aperture in said arm to said rear wheel stop lever.

4. A three wheel roller skate as recited in claim 2, wherein each said front connector assembly includes:

a) a pulley carried in a rotatable manner from the inner surface of said base adjacent said front wheel stop lever; and b) a cable extending from the front of said control cam about said pulley to said front wheel stop lever.

5. A three wheel roller skate which comprises:

a) a boot having a sole, wherein said boot is worn on a foot of a roller skater;

b) a support frame which is a generally U-shaped bracket attached to said sole of said boot in an inverted manner, said U-shaped bracket including:

i) a base attached to said sole of said boot;

ii) a pair of rear wheels mounted in a rotatable manner to a rear end of said support frame; and iii) a front wheel mounted in a rotatable manner to a front end of said support frame, so that said roller skate can be better maneuvered by the roller skate; and iv) a pair of arms extending downwardly from said base, wherein each axle of said rear wheels is mounted to an exterior surface of one said arm, while an axle of said front wheel is mounted between interior surfaces of said arms;

c) means for preventing said front wheel from rotating backwards, so as to allow said front wheel to only rotate forwards, said preventing means including:

i) a control cam mounted in a rotatable manner between said arms;

ii) a pair of front wheel anti-reverse levers, in which each said front wheel anti-reverse lever is spring biased hinged to the interior surface of one said arm, so that each said front wheel anti-reverse lever will normally be disengaged from said bores in said front wheel;

iii) a control change key insertable into said control cam, so as to rotate said control cam in a first direction to disengage said front wheel anti-reverse levers from said bores in said front wheel; and iv) a pair of auxiliary front connector assemblies extending between said control cam and said front wheel anti-reverse levers, so that when said control change key in said control cam rotates said control cam in an opposite direction, said anti-reverse levers will now engage with said bores in said front wheel, to allow said front wheel to rotate forwards but not backwards.

6. A three wheel roller skate as recited in claim 5, wherein each said auxiliary front connector assembly includes:

a) a pulley carried in a rotatable manner from an inner surface of one said arm adjacent said front wheel anti-reverse lever; and b) a cable extending from the front of said control cam about said pulley to said front wheel anti-reverse lever.

7. A three wheel roller skate which comprises:

a) a boot having a sole wherein said boot is worn on a foot of a roller skater;

b) a support frame which is a generally U-shaped bracket attached to said sole of said boot in an inverted manner, said U-shaped bracket including:

i) a base attached to said sole of said boot;

ii) a pair of rear wheels mounted in a rotatable manner to a rear end of said support frame; and iii) a front wheel mounted in a rotatable manner to a front end of said support frame, so that said roller skate can be better maneuvered by the roller skate; and iv) a pair of arms extending downwardly from said base, wherein each axle of said rear wheels is mounted to an exterior surface of one said arm, while an axle of said front wheel is mounted between interior surfaces of said arms;

c) means for locking said rear wheels and said front wheel, so as to prevent said rear wheels and said front wheel from rotating, said locking means including:

i) each said rear wheel having a plurality of apertures radially positioned on an inner surface about the axle and facing the exterior surface of one said arm;

ii) a pair of rear wheel stop levers, in which each said rear wheel stop lever is spring biased hinged to the exterior surface of one said arm, so that each said rear wheel stop lever will normally engage with one said aperture in one said rear wheel;

iii) said front wheel having a plurality of bores radially positioned on opposite surfaces about the axle and facing the interior surfaces of said arms; and iv) a pair of front wheel stop levers, in which each said front wheel stop lever is spring biased hinged to the interior surface of one said arm, so that each said front wheel stop lever will normally engage with one said bore in said front wheel;

d) means for unlocking said rear wheels and said front wheel, so as to allow said rear wheels and said front wheel to rotate; and e) means for preventing said front wheel from rotating backwards, so as to allow said front wheel to only rotate forwards.

8. A three wheel roller skate as recited in claim 7, wherein said unlocking means includes:

a) a control cam mounted in a rotatable manner between said arms;

b) a pair of rear connector assemblies extending between said control cam and said rear wheel stop levers;

c) a pair of front connector assemblies extending between said control cam and said front wheel stop levers; and d) a control change key insertable into said control cam, so as to rotate said control cam in a first direction to release said rear wheel stop levers from said apertures in said rear wheels and said front wheel stop levers from said bores in said front wheel.

9. A three wheel roller skate as recited in claim 8, wherein said preventing means includes:

a) a pair of front wheel anti-reverse levers, in which each said front wheel anti-reverse lever is spring biased hinged to the interior surface of one said arm, so that each said front wheel anti-reverse lever will normally be disengaged from said bores in said front wheel; and b) a pair of auxiliary front connector assemblies extending between said control cam and said front wheel anti-reverse levers, so that when said control change key in said control cam rotates said control cam in an opposite direction, said anti-reverse levers will now engage with said bores in said front wheel, to allow said front wheel to rotate forwards but not backwards.

10. A three wheel roller skate as recited in claim 9, wherein each rear connector assembly includes:

a) a first pulley carried in a rotatable manner on the inner surface of one said arm, spaced behind said control cam;

b) a second pulley carried in a rotatable manner on the inner surface of said arm spaced below at a right angle to said first pulley adjacent one said rear wheel stop lever in front of said arm; and c) a cable extending from the back of said control cam about said first pulley, said second pulley and through an aperture in said arm to said rear wheel stop lever.

11. A three wheel roller skate as recited in claim 10, wherein each said front connector assembly includes:

a) a pulley carried in a rotatable manner from the inner surface of said base adjacent said front wheel stop lever; and b) a cable extending from the front of said control cam about said pulley to said front wheel stop lever.

12. A three wheel roller skate as recited in claim 11, wherein each said auxiliary front connector assembly includes:

a) a pulley carried in a rotatable manner from an inner surface of one said arm adjacent said front wheel anti-reverse lever; and b) a cable extending from the front of said control cam about said pulley to said front wheel anti-reverse lever.

* * * * *